US007763165B1

(12) United States Patent
Schultz

(10) Patent No.: US 7,763,165 B1
(45) Date of Patent: Jul. 27, 2010

(54) FRACTIONATION RECOVERY PROCESSING OF FCC-PRODUCED LIGHT OLEFINS

(75) Inventor: Michael A. Schultz, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 833 days.

(21) Appl. No.: 11/643,926

(22) Filed: Dec. 21, 2006

(51) Int. Cl.
*B01D 3/00* (2006.01)
*C10G 57/00* (2006.01)
*C10G 11/00* (2006.01)
*C10G 5/00* (2006.01)

(52) U.S. Cl. ..... 208/354; 208/67; 208/113; 208/340

(58) Field of Classification Search ..... 208/46, 208/49, 67, 72–77, 106, 113–124, 308, 340, 208/347, 350, 354
See application file for complete search history.

(56) References Cited

U.S. PATENT DOCUMENTS 2,813,920 A * 11/1957 Cobb, Jr. ..... 208/104
3,477,946 A * 11/1969 Borst, Jr. ..... 208/342
3,537,978 A * 11/1970 Borst, Jr. ..... 208/341
4,003,822 A 1/1977 Jo
4,072,604 A * 2/1978 Ward ..... 208/341
4,356,014 A * 10/1982 Higgins ..... 62/622
4,456,781 A * 6/1984 Marsh et al. ..... 585/533
5,360,533 A 11/1994 Tagamolila et al.
5,447,621 A 9/1995 Hunter
5,584,985 A 12/1996 Lomas
5,858,206 A 1/1999 Castillo
6,110,356 A 8/2000 Hedrick et al.
6,538,169 B1 * 3/2003 Pittman et al. ..... 208/114
6,540,907 B1 4/2003 Towler et al.
6,726,835 B2 * 4/2004 Towler et al. ..... 208/347
6,843,906 B1 1/2005 Eng
6,927,314 B1 8/2005 Schultz et al.
6,946,068 B2 9/2005 Groten

FOREIGN PATENT DOCUMENTS

EP 1 637 577 A2 3/2006

OTHER PUBLICATIONS

U.S. Appl. No. 11/540,793, filed Sep. 28, 2006.
U.S. Appl. No. 11/540,110, filed Sep. 28, 2006.
U.S. Appl. No. 11/541,218, filed Sep. 28, 2006.
U.S. Appl. No. 11/541,310, filed Sep. 28, 2006.
U.S. Appl. No. 11/540,088, filed Sep. 28, 2006.
U.S. Appl. No. 11/541,200, filed Sep. 28, 2006.

* cited by examiner

*Primary Examiner*—Glenn Caldarola
*Assistant Examiner*—Randy Boyer
(74) *Attorney, Agent, or Firm*—James C. Paschall

(57) ABSTRACT

Processing schemes and arrangements are provided for the processing a heavy hydrocarbon feedstock via hydrocarbon cracking processing with selected hydrocarbon fractions being obtained via fractionation-based product recovery.

18 Claims, 2 Drawing Sheets

FRACTIONATION RECOVERY PROCESSING OF FCC-PRODUCED LIGHT OLEFINS

BACKGROUND OF THE INVENTION

This invention relates generally to hydrocarbon processing and, more particularly, to the processing of hydrocarbon-containing materials having a high light olefin content, such as produced or formed in or by the cracking of a heavy hydrocarbon feedstock.

Light olefins serve as feed materials for the production of numerous chemicals. Light olefins have traditionally been produced through the processes of steam or catalytic cracking of hydrocarbons such as derived from petroleum sources. Fluidized catalytic cracking (FCC) of heavy hydrocarbon streams is commonly carried out by contacting a starting material whether it be vacuum gas oil, reduced crude, or another source of relatively high boiling hydrocarbons with a catalyst such as composed of finely divided or particulate solid material. The catalyst is transported in a fluid-like manner by transmitting a gas or vapor through the catalyst at sufficient velocity to produce a desired regime of fluid transport. Contact of the oil with the fluidized material catalyzes the cracking reaction.

The cracking reaction typically deposits coke on the catalyst. Catalyst exiting the reaction zone is commonly referred to as being "spent", i.e., partially deactivated by the deposition of coke upon the catalyst. Coke is comprised of hydrogen and carbon and can include, in trace quantities, other materials such as sulfur and metals such that may enter the process with the starting material. The presence of coke interferes with the catalytic activity of the spent catalyst. It is believed that the coke blocks acid sites on the catalyst surface where the cracking reactions take place. Spent catalyst is traditionally transferred to a stripper that removes adsorbed hydrocarbons and gases from catalyst and then to a regenerator for the purpose of removing the coke by oxidation with an oxygen-containing gas. An inventory of catalyst having a reduced coke content, relative to the spent catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated between the reaction zone and the regeneration zone. The fluidized catalyst, as well as providing a catalytic function, serves as a vehicle for the transfer of heat from zone to zone. FCC processing is more fully described in U.S. Pat. No. 5,360,533 to Tagamolila et al., U.S. Pat. No. 5,584,985 to Lomas, U.S. Pat. No. 5,858,206 to Castillo and U.S. Pat. No. 6,843,906 B1 to Eng. Specific details of the various contact zones, regeneration zones, and stripping zones along with arrangements for conveying the catalyst between the various zones are well known to those skilled in the art.

The FCC reactor serves to crack gas oil or heavier feeds into a broad range of products. Cracked vapors from an FCC unit enter a separation zone, typically in the form of a main column, that provides a gas stream, a gasoline cut, light cycle oil (LCO) and clarified oil (CO) which includes heavy cycle oil (HCO) components. The gas stream may include dry gas, i.e., hydrogen and $C_1$ and $C_2$ hydrocarbons, and liquefied petroleum gas ("LPG"), i.e., $C_3$ and $C_4$ hydrocarbons, also sometimes commonly referred to as wet gas.

In view of an increasing need and demand for light olefins such as ethylene and propylene for various petrochemical uses such as for the production of polyethylene, polypropylene and the like as well as the desire to produce relatively less of heavier olefins such as butylenes and pentenes which are generally less desirable as gasoline blending components due to environmental considerations, it may be desired to practice the cracking reaction processing of heavy hydrocarbon feedstock to increase the relative amount of light olefins in the resulting product slate.

Research efforts have led to the development of an FCC process that produces or results in greater relative yields of light olefins, i.e., ethylene and propylene. Such processing is more fully described in U.S. Pat. No. 6,538,169 B1 to Pittman et al. As disclosed therein, a hydrocarbon feed stream can desirably be contacted with a blended catalyst comprising regenerated catalyst and coked catalyst. The catalyst has a composition including a first component and a second component. The second component comprises a zeolite with no greater than medium pore size wherein the zeolite comprises at least 1 wt. % of the catalyst composition. The contacting occurs in a riser to crack hydrocarbons in the feed stream and obtain a cracked stream containing hydrocarbon products including light olefins and coked catalyst. The cracked stream is passed out of an end of the riser such that the hydrocarbon feed stream is in contact with the blended catalyst in the riser for less than or equal to 2 seconds on average.

In view of the increasing need and demand for light olefins such as ethylene and propylene, there is a need and a demand for improved processing and arrangements for the separation and recovery of such light olefins from such FCC processing effluent.

SUMMARY OF THE INVENTION

A general object of the invention is to provide an improved process and system for catalytically cracking a heavy hydrocarbon feedstock and obtaining selected hydrocarbon fractions.

The general object of the invention can be attained, at least in part, through a specified process such as involves contacting a heavy hydrocarbon feedstock with a hydrocarbon cracking catalyst in a fluidized reactor zone to produce a hydrocarbon effluent comprising a range of hydrocarbon products including light olefins. In accordance with one preferred embodiment, the hydrocarbon cracking catalyst desirably is of a catalyst composition including a first component comprising a large pore molecular sieve and a second component comprising a zeolite with no greater than medium pore size, said zeolite with no greater than medium pore size comprising at least 1.0 wt. % of the catalyst composition. The hydrocarbon effluent is separated in a separation section to form at least one separator liquid stream and a separator vapor stream. The at least one separator liquid stream comprises $C_4$+ hydrocarbons. The separator vapor stream comprises $C_4$− hydrocarbons. At least a portion of the separator vapor stream is deethanized in a deethanizer to at least form a first deethanizer process stream comprising $C_2$− hydrocarbons including a quantity of ethylene and a second deethanizer process stream comprising $C_3$+ hydrocarbons including a quantity of propylene. The second deethanizer process stream is depropanized to form a first depropanizer process stream comprising $C_3$ hydrocarbons and a second depropanizer process stream comprising $C_4$+ hydrocarbons. At least a portion of the second depropanizer process stream is subsequently split in a naphtha splitter to at least form a first naphtha splitter process stream comprising primarily compounds containing four to six carbon atoms.

The prior art generally fails to provide processing schemes and arrangements for obtaining light olefins via the catalytic cracking of a heavy hydrocarbon feedstock in an as effective and efficient a manner as may be desired. More particularly, the prior art generally fails to provide such processing schemes and arrangements that advantageously utilize fractionation processing of hydrocarbon effluent products to produce or otherwise form process streams containing specifically desired ranges of hydrocarbons.

A process for catalytically cracking a heavy hydrocarbon feedstock and obtaining selected hydrocarbon fractions, in accordance with another embodiment, involves contacting a heavy hydrocarbon feedstock with a hydrocarbon cracking catalyst in a fluidized reactor zone to produce a hydrocarbon effluent comprising a range of hydrocarbon products including light olefins., the hydrocarbon cracking catalyst having a catalyst composition including a first component comprising a large pore molecular sieve and a second component comprising a zeolite with no greater than medium pore size. In accordance with one preferred practice of such embodiment, the zeolite having no greater than medium pore size desirably comprises at least 1.0 wt. % of the catalyst composition. The hydrocarbon effluent is separated in a separation section to form at least one separator liquid stream and a separator vapor stream. The at least one separator liquid stream comprises $C_4$+ hydrocarbons. The separator vapor stream comprises $C_4$− hydrocarbons. The process further requires that at least a portion of the separator vapor stream be deethanized in a deethanizer to at least form a first deethanizer process stream comprising $C_2$− hydrocarbons including a quantity of ethylene and a second deethanizer process stream comprising $C_3$+ hydrocarbons including a quantity of propylene. The second deethanizer process stream is depropanized to form a first depropanizer process stream comprising $C_3$ hydrocarbons and a second depropanizer process stream comprising $C_4$+ hydrocarbons including $C_4$-$C_7$ olefins. At least a portion of the $C_4$-$C_7$ olefins are cracked to form a cracked olefin effluent comprising $C_2$ and $C_3$ olefins. At least a portion of the cracked olefin effluent is depropanized to form a first cracked olefin effluent process stream comprising $C_3$− hydrocarbons including $C_2$ and $C_3$ olefins and a second cracked olefin effluent process stream comprising $C_4$+ hydrocarbons. At least a portion of the second cracked olefin effluent process stream is split in a naphtha splitter comprising a dividing wall separation column to form a light fraction comprising compounds containing four to six carbon atoms, an intermediate fraction comprising compounds containing seven to eight carbon atoms and a heavy fraction comprising compounds containing more than eight carbon atoms.

A system for catalytically cracking a heavy hydrocarbon feedstock and obtaining selected hydrocarbon fractions is also provided. In accordance with one preferred embodiment, such as system includes a fluidized reactor zone wherein the heavy hydrocarbon feedstock contacts with a hydrocarbon cracking catalyst having a catalyst composition including a first component comprising a large pore molecular sieve and a second component comprising a zeolite with no greater than medium pore size to produce a hydrocarbon effluent comprising a range of hydrocarbon products. The zeolite is desirably with no greater than medium pore size comprising at least 1.0 wt. % of the catalyst composition.

The system further includes a separation section to separate the cracked hydrocarbon effluent to form at least one separator liquid stream and a separator vapor stream. The at least one separator liquid stream desirably comprises $C_4$+ hydrocarbons. The separator vapor stream desirably comprises $C_4$− hydrocarbons. A deethanizer is provided to deethanize at least a portion of the separator vapor stream to at least form a first deethanizer process stream comprising $C_2$− hydrocarbons including a quantity of ethylene and a second deethanizer process stream comprising $C_3$+ hydrocarbons including a quantity of propylene. A depropanizer is provided to depropanize the second deethanizer process stream to form a first depropanizer process stream comprising $C_3$ hydrocarbons and a second depropanizer process stream comprising $C_4$+ hydrocarbons. The system further includes a naphtha splitter to split at least a portion of the second depropanizer process stream to at least form a first naphtha splitter process stream comprising primarily compounds containing four to six carbon atoms.

As used herein, references to "light olefins" are to be understood to generally refer to $C_2$ and $C_3$ olefins, i.e., ethylene and propylene, alone or in combination.

References to "$C_x$ hydrocarbon" are to be understood to refer to hydrocarbon molecules having the number of carbon atoms represented by the subscript "x". Similarly, the term "$C_x$-containing stream" refers to a stream that contains $C_x$ hydrocarbon. The term "$C_x$+ hydrocarbons" refers to hydrocarbon molecules having the number of carbon atoms represented by the subscript "x" or greater. For example, "$C_4$+ hydrocarbons" include $C_4$, $C_5$ and higher carbon number hydrocarbons. The term "$C_x$− hydrocarbons" refers to hydrocarbon molecules having the number of carbon atoms represented by the subscript "x" or fewer. For example, "$C_4$− hydrocarbons" include $C_4$, $C_3$ and lower carbon number hydrocarbons.

Other objects and advantages will be apparent to those skilled in the art from the following detailed description taken in conjunction with the appended claims and drawings.

Those skilled in the art and guided by the teachings herein provided will recognize and appreciate that the illustrated systems or process flow diagrams have been simplified by the elimination of various usual or customary pieces of process equipment including some heat exchangers, process control systems, pumps, fractionation systems, and the like. It may also be discerned that the process flow depicted in the figures may be modified in many aspects without departing from the basic overall concept of the invention.

DETAILED DESCRIPTION

Figure 1:
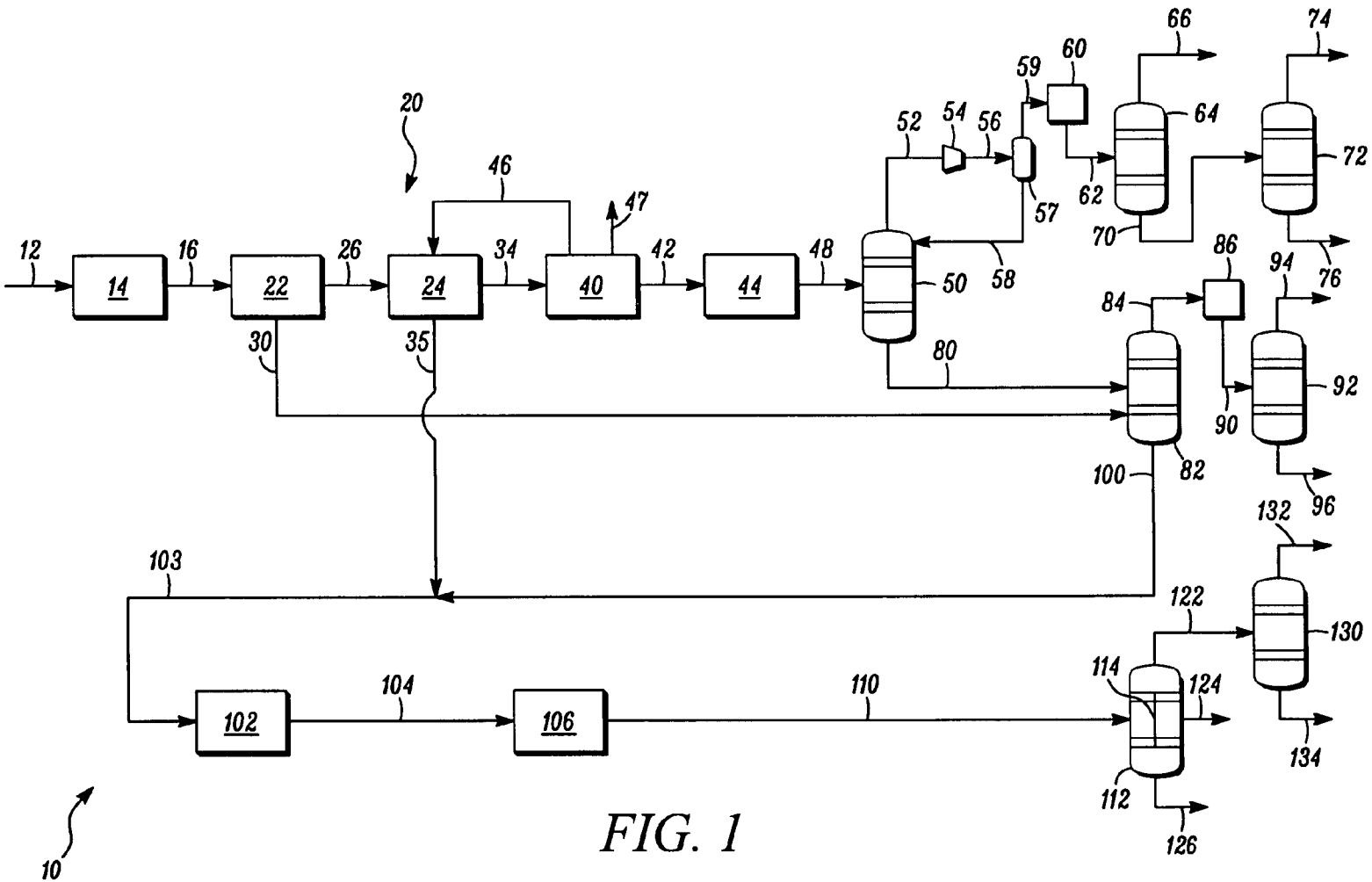
FIG. 1 is a simplified schematic diagram of a system for catalytic cracking a heavy hydrocarbon feedstock and obtaining selected hydrocarbon fractions, including light olefins via fractionation recovery, in accordance with one preferred embodiment.

Processing schemes and arrangements are provided for effectively and efficiently processing a heavy hydrocarbon feedstock via hydrocarbon cracking processing with selected hydrocarbon fractions being obtained via fractionation recovery As will be appreciated such processing may be embodied in a variety of processing arrangements. As representative, FIG. 1 illustrates a system, generally designated by the reference numeral 10, for the catalytic cracking of a heavy hydrocarbon feedstock and obtaining light olefins via fractionation recovery, in accordance with one embodiment of the invention.

In the system 10, a suitable heavy hydrocarbon feedstock stream is introduced via a line 12 into a fluidized reactor zone 14 wherein the heavy hydrocarbon feedstock contacts with a hydrocarbon cracking catalyst zone to produce a hydrocarbon effluent comprising a range of hydrocarbon products, including light olefins.

Suitable fluidized catalytic cracking reactor zones for use in the practice of such an embodiment may, as is described in above-identified U.S. Pat. No. 6,538,169 B1 to Pittman et al., include a separator vessel, a regenerator, a blending vessel, and a vertical riser that provides a pneumatic conveyance zone in which conversion takes place. The arrangement circulates catalyst and contacts feed in a specifically described manner.

More specifically and as described therein, the catalyst typically comprises two components that may or may not be on the same matrix. The two components are circulated throughout the entire system. The first component may include any of the well-known catalysts that are used in the art of fluidized catalytic cracking, such as an active amorphous clay-type catalyst and/or a high activity, crystalline molecular sieve. Molecular sieve catalysts are preferred over amorphous catalysts because of their much-improved selectivity to desired products. Zeolites are the most commonly used molecular sieves in FCC processes. Preferably, the first catalyst component comprises a large pore zeolite, such as a Y-type zeolite, an active alumina material, a binder material, comprising either silica or alumina and an inert filler such as kaolin.

The zeolitic molecular sieves appropriate for the first catalyst component should have a large average pore size. Typically, molecular sieves with a large pore size have pores with openings of greater than 0.7 nm in effective diameter defined by greater than 10 and typically 12 membered rings. Pore Size Indices of large pores are above about 31. Suitable large pore zeolite components include synthetic zeolites such as X-type and Y-type zeolites, mordenite and faujasite. It has been found that Y zeolites with low rare earth content are preferred in the first catalyst component. Low rare earth content denotes less than or equal to about 1.0 wt. % rare earth oxide on the zeolite portion of the catalyst. Octacat™ catalyst made by W. R. Grace & Co. is a suitable low rare earth Y-zeolite catalyst.

The second catalyst component comprises a catalyst containing, medium or smaller pore zeolite catalyst exemplified by ZSM-5, ZSM-11, ZSM-12, ZSM-23, ZSM-35, ZSM-38, ZSM-48, and other similar materials. U.S. Pat. No. 3,702,886 describes ZSM-5. Other suitable medium or smaller pore zeolites include ferrierite, erionite, and ST-5, developed by Petroleos de Venezuela, S. A. The second catalyst component preferably disperses the medium or smaller pore zeolite on a matrix comprising a binder material such as silica or alumina and an inert filer material such as kaolin. The second component may also comprise some other active material such as Beta zeolite. These catalyst compositions have a crystalline zeolite content of 10-25 wt. % or more and a matrix material content of 75-90 wt. %. Catalysts containing 25 wt. % crystalline zeolite material are preferred. Catalysts with greater crystalline zeolite content may be used, provided they have satisfactory attrition resistance. Medium and smaller pore zeolites are characterized by having an effective pore opening diameter of less than or equal to 0.7 nm, rings of 10 or fewer members and a Pore Size Index of less than 31.

The total catalyst composition should contain 1-10 wt. % of a medium to small pore zeolite with greater than or equal to 1.75 wt. % being preferred. When the second catalyst component contains 25 wt. % crystalline zeolite, the composition contains 4-40 wt. % of the second catalyst component with a preferred content of greater than or equal to 7 wt. %. ZSM-5 and ST-5 type zeolites are particularly preferred since their high coke resistivity will tend to preserve active cracking sites as the catalyst composition makes multiple passes through the riser, thereby maintaining overall activity. The first catalyst component will comprise the balance of the catalyst composition. The relative proportions of the first and second components in the catalyst composition will not substantially vary throughout the FCC unit.

The high concentration of the medium or smaller pore zeolite in the second component of the catalyst composition improves selectivity to light olefins by further cracking the lighter naphtha range molecules. But at the same time, the resulting smaller concentration of the first catalyst component still exhibits sufficient activity to maintain conversion of the heavier feed molecules to a reasonably high level.

The relatively heavier feeds suitable for processing in accordance herewith include conventional FCC feedstocks or higher boiling or residual feeds. A common conventional feedstock is vacuum gas oil which is typically a hydrocarbon material prepared by vacuum fractionation of atmospheric residue and which has a broad boiling range of from 315-622° C. (600-1150° F.) and, more typically, which has a narrower boiling point range of from 343-551° C. (650-1025° F.). Heavy or residual feeds, i.e., hydrocarbon fractions boiling above 499° C. (930° F.), are also suitable. The fluidized catalytic cracking processing the invention is typically best suited for feedstocks that are heavier than naphtha range hydrocarbons boiling above about 177° C. (350° F.).

The effluent from the fluidized reactor zone 14 is passed through a line 16 into a hydrocarbon separation system 20, such as includes a main column section 22 and a staged compression section 24. The main column section 22 may desirably include a main column separator with an associated main column overhead high pressure receiver wherein the fluidized reactor zone effluent can be separated into desired fractions including a main column vapor stream, such as passed through a line 26, and a main column liquid stream, such as passed through a line 30.

To facilitate illustration and discussion, other fraction lines such as including a heavy gasoline stream, a light cycle oil ("LCO") stream, a heavy cycle oil ("HCO") stream and a clarified oil ("CO") stream, for example, may not here be shown nor hereinafter specifically described.

The main column vapor stream line 26 is introduced into the staged compression section 24, such as constituting a three-stage compression. The staged compression section 24 results in the formation of a high pressure separator vapor stream in a line 34. Such high pressure separator vapor stream typically primarily comprises $C_4$– hydrocarbons and includes a quantity of carbon dioxide. While the pressure of such high pressure vapor and, in turn, corresponding high pressure liquid, can vary, in practice such streams are typically at a pressure in the range of about 1650 kPa to about 1930 kPa (about 240 psia to about 280 psia).

The compression section 24 may also result in the formation of a stream of spill back materials largely composed of heavier hydrocarbon materials and typically in the form of a liquid. Such liquid material typically primarily comprises $C_4$+ hydrocarbons and is substantially free of carbon dioxide. Such spill back material can be passed via one or more lines 35 for further processing or treatment as later described herein.

The separator vapor stream is passed via the line 34 and, if desired and as shown, may be introduced into an amine treatment section 40 such as may be desired to effect $CO_2$ removal therefrom. The utilization of amine treatment systems for carbon dioxide and/or hydrogen sulfide removal are well known in the art. Conventional such amine treatment systems typically employ an amine solvent such as methyl diethanol amine [MDEA] to absorb or otherwise separate $CO_2$ from hydrocarbon stream materials. A stripper or regenerator is typically subsequently used to strip the absorbed $CO_2$ from the amine solvent, permitting the reuse of the amine solvent.

While such amine treatment has proven generally effective for removal of carbon dioxide from various hydrocarbon-containing streams, the application of such amine treatment to ethylene-rich hydrocarbon and carbon dioxide-containing streams, such as being processed at this point of the subject system, may experience some undesired complications as some of the olefin material may be co-absorbed with the $CO_2$ in or by the amine solvent. Such co-absorption of olefin material undesirably reduces the amounts of light olefins available for recovery from such processing. Moreover, during such subsequent stripper processing of the amine solvent, the presence of such olefin materials can lead to polymerization. Such polymerization can lead to degradation of the amine solvent and require expensive off-site reclamation processing.

In view thereof, it may be desirable to utilize an amine treatment system such as includes or incorporates a pre-stripper interposed between the amine system absorber and the amine system stripper/regenerator. Such an interposed pre-stripper, can desirably serve to separate hydrocarbon materials, including light olefins such as ethylene, from the carbon dioxide and amine solvent prior to subsequent processing through the regenerator/stripper.

A stream containing $C_4$– hydrocarbons substantially free of carbon dioxide is passed through a line 42 to a drier section 44, such as in the form of an adsorbent drier. Those skilled in the art and guided by the teachings herein provided will, however, appreciate that suitable other forms of driers such as known in the art can, if desired, be used.

A stream containing stripped hydrocarbons and possibly minor amounts (e.g., typically less than 1 wt. %) of $CO_2$ is conveyed via a line 46 back to the compression section 24 such as for further processing such as consistent with the above description.

A stream containing $CO_2$ rich purge gas is conveyed from the amine treatment section 40 via a line 47.

A stream containing dried $C_4$– hydrocarbons substantially free of carbon dioxide is passed via a line 48 to a deethanizer 50. A suitable such deethanizer, in accordance with one preferred embodiment, generally desirably operates at a feed temperature in the range of about 54° C. (corresponding to operation with no post compression heat exchange) to about −40° C. (about 130° F. to about −40° F.) and in accordance with a preferred embodiment with a feed temperature in the range of about 17° C. to about −40° C. (about 0° F. to about −40° F.), more preferably at about −40° C. (about −40° F.); a top tray temperature in the range of about −34° C. to about −46° C. (about −30° F. to about −50° F.) and in accordance with a preferred top tray temperature of about −46° C. (about −50° F.); and with a $C_2$ recovery generally of at least 98 mol %, preferably with a $C_2$ recovery of at least 99 mol % to about 99.9 mol % and, more preferably with a $C_2$ recovery of at least 99.9 mol %.

From the deethanizer 50, a stream of $C_2$– hydrocarbons is taken overhead via a line 52. The line 52 and the stream of materials therein contained are introduced into a compressor section 54 to form a corresponding stream of compressed materials (such as being at a pressure in the range of about 3720 kPa gauge to about 3865 kPa gauge (about 540 psig to about 560 psig)) that are passed through a line 56 to an overhead receiver 57. From the overhead receiver 57, a stream of the compressed material is passed via a line 58 as a reflux to the deethanizer 50 and a stream of the compressed material is passed via a line 59 to an acetylene conversion section or unit 60. As is known in the art, acetylene conversion sections or units are effective to convert acetylene to form ethylene. Thus, an additionally ethylene-enriched process stream is withdrawn in a line 62 from the acetylene conversion section or unit 60.

The process stream in the line 62 is introduced into a demethanizer 64. A suitable such demethanizer, in accordance with one preferred embodiment, includes a condenser (not specifically shown) that desirably operates at a temperature of no greater than about −90° C. (−130° F.), more preferably operates at a temperature in the range of about −0° C. to about −102° C., preferably about −96° C. (−130° F. to about −150° F., preferably at about −140° F.). In addition, a preferred demethanizer for use in the practice of the invention desirably operates with a methane to ethylene molar ratio in the bottoms of no greater than about 0.0005 and, more preferably at a methane to ethylene molar ratio in the bottoms of no greater than about 0.0003 to about 0.0002.

A stream of methane and hydrogen gas from the demethanizer 64 is taken overhead by via a line 66 such as for use as a fuel or, if desired for further processing or treatment such as to a pressure swing absorption unit (not shown) for $H_2$ recovery. A line 70 withdraws a stream of demethanized material from the demethanizer 64. The stream of demethanized material in line 70 is passed to an ethylene/ethane splitter 72. A suitable such ethane/ethylene splitter, in accordance with one preferred embodiment, includes a condenser (not specifically shown) that desirably operates at a pressure in the range of about 1930 kPa gauge to about 2105 kPa gauge (about 280 psig to about 305 psig), and desirably operates such that there is no more than about 0.5 vol. % ethane in the ethylene product stream, preferably less than about 0.1 vol. % ethane in the ethylene product stream and, more preferably, less than about 0.05 vol. % ethane in the ethylene product stream.

The ethylene/ethane splitter 72 forms a stream of ethylene and a stream of ethane which are passed through lines 74 and 76, respectively, such as either for product recovery or further desired processing, as is known in the art.

The deethanizer 50 also produces or forms a stream of $C_3$+ hydrocarbons such as withdrawn therefrom via a line 80. The line 80 introduces the materials passing therein into a depropanizer 82. In addition and as shown, the main column liquid stream line 30 can also desirably be introduced into the depropanizer 82.

A suitable such depropanizer, in accordance with one preferred embodiment, includes a condenser (not specifically shown) that desirably operates at a pressure in the range of about 1030 kPa gauge to about 1175 kPa gauge (about 150 psig to about 170 psig), with a recovery of at least about 98 mol % of the $C_3$ hydrocarbons in the overhead, more preferably with the recovery of at least in the range of 98-99.5 mol % of the $C_3$ hydrocarbons in the overhead and at least 95 mol % of the $C_4$+ hydrocarbons in the bottoms product, more preferably with the recovery of at least about 95 mol % to about 99 mol % of the $C_4$+ hydrocarbons in the bottoms product.

A stream of $C_3$ hydrocarbons is taken overhead from the depropanizer 82 via a line 84. This stream of $C_3$ hydrocarbons, in addition to propane and propylene may contain significant relative amounts or quantities of $C_3$ diolefin hydrocarbons. Thus, as shown and in accordance with one preferred embodiment, the system 10 may desirably include or contain a selective hydrogenation process unit 86 to convert such diolefinic materials to corresponding olefin materials.

The resulting stream is passed via a line 90 to a propylene/propane splitter 92. A suitable such propane/propylene splitter, in accordance with one preferred embodiment, desirably operates such that at least 98 wt. % and, preferably, at least about 99 wt. % of the propylene recovery is in the overhead stream and the propylene in the overhead stream is at least about 99.5% pure.

The propylene/propane splitter 92 forms a stream of propylene and a stream of propane which are passed through lines 94 and 96, respectively, such as either for product recovery or further desired processing, as is known in the art.

A line 100 withdraws a stream containing residual $C_4$+ hydrocarbons from the depropanizer 82. If desired and as shown, the line 100 with the stream containing residual $C_4$+ hydrocarbons from the depropanizer 82 can be introduced into a mercaptan treatment section 102, such as via a line 103, such as to effect mercaptan removal from the stream materials such as via caustic wash as is known in the art. In the illustrated embodiment, the liquid from the line 35 can also desirably be introduced into the mercaptan treatment section 102 via the line 103 such as to effect mercaptan removal therefrom.

A resulting stream is withdrawn from the mercaptan treatment section 102 via a line 104. As such stream materials may contain diolefinic materials, in the illustrated embodiment, the line 104 is shown as leading into a selective hydrogenation process unit 106 to convert such diolefinic materials to corresponding olefin materials. The resulting stream containing $C_4$+ hydrocarbons is passed via a line 110 such as for either product recovery or further desired processing, such as described below.

While in the above-described embodiment, the line 100 containing the stream of residual $C_4$+ hydrocarbons withdrawn from the depropanizer 82 has been shown as being introduced into the mercaptan treatment section 102, those skilled in the art and guided by the teaching herein provided will appreciate that the broader practice of the invention is not necessarily so limited. For example, if desired, such as in instances or situations wherein such stream of residual $C_4$+ hydrocarbons contains little or no mercaptans, such stream of materials can be passed directly to the selective hydrogenation process unit 106.

In accordance with one preferred embodiment and as shown in the FIG. 1, the resulting stream containing $C_4$+ hydrocarbons passed via the line 110 can desirably be introduced into a naphtha splitter 112.

In accordance with one preferred embodiment, the naphtha splitter 112 is desirably in the form of a dividing wall separation column, such as having a dividing wall 114 positioned therewithin. Such a dividing wall separation column naphtha splitter is desirably effective to separate the treated depropanized materials introduced therein into a light fraction stream comprising compounds containing four to six carbon atoms, an intermediate fraction stream comprising compounds containing seven to eight carbon atoms, and a heavy fraction stream comprising compounds containing more than eight carbon atoms. More specifically, such a dividing wall separation column may generally operate at a condenser pressure in the range of about 34 kPa gauge to about 104 kPa gauge (about 5 psig to about 15 psig) and, in accordance with one embodiment operated at a condenser pressure of about 55 kPa gauge to about 85 kPa gauge (about 8 psig to about 12 psig).

Such a dividing wall separation column typically operates in a more energy efficient manner than a simple sidedraw column and also desirably produces a sharper product split than normally obtainable with conventional sidedraw columns.

Further, in accordance with a preferred embodiment, the products produced or formed by or from the dividing wall column may desirably include a distillate having a Total Boiling Point (TBP) at the 95% cut point in the range of about 72° to about 78° C. (about 162° to about 172° F.) and, more specifically, about 75° C. (167° F.) and a side product having a TBP at the 5% cut point in the range of about 72° to about 78° C. (about 162° to about 172° F.) and, more specifically, about 75° C. (167° F.) and a TBP at the 95% cut point the range of about 167° to about 173° C. (about 333° to about 343° F.) and, more specifically, about 170° C. (338° F.).

As will be appreciated by those skilled in the art and guided by the teachings herein provided, such light, intermediate and heavy fraction streams may desirably be appropriately passed such as via corresponding lines 122, 124, and 126, respectively, either for further processing or product recovery, as may be desired. For example and as shown, the light fraction stream of the line 122 can desirably be introduced into a debutanizer 130.

A suitable such debutanizer, in accordance with one preferred embodiment, includes a condenser (not specifically shown) that desirably operates at a pressure in the range of about 965 kPa gauge to about 1105 kPa gauge (about 140 psig to about 160 psig), with a recovery of at least about 98 mol % of the $C_3$ hydrocarbons in the overhead, more preferably with the recovery of at least in the range of 98-99.5 mol % of the $C_3$− materials in the overhead and at least 95 mol % of the $C_4$ hydrocarbons and the $C_5$ hydrocarbons, respectively, in the bottoms product, more preferably with the recovery of at least about 95 mol % to about 99 mol % of the $C_4$+ hydrocarbons in the bottoms product.

A stream of mixed $C_4$ hydrocarbons is taken overhead from the debutanizer 130 via a line 132. A stream primarily comprising compounds containing $C_5$ and $C_6$ compounds is taken from the debutanizer 130 via a bottoms stream in a line 134.

While such processing can be effective and efficient in the recovery light olefins such as produced or resulting from the catalytic cracking a heavy hydrocarbon feedstock, light olefin recovery can be further enhanced or increased by integrating such processing with the cracking of heavier olefins that may also be produced or result from the processing of the heavy hydrocarbon feedstock. One such processing arrangement, in accordance with one preferred embodiment, is shown as a system, generally designated by the reference numeral 210, and illustrated in FIG. 2.

The system 210 is in some respects generally similar to the system 10 shown in FIG. 1 and described above. For example, in the system 210, a suitable heavy hydrocarbon feedstock stream is introduced via a line 212 into a fluidized reactor zone 214 wherein the heavy hydrocarbon feedstock contacts with a hydrocarbon cracking catalyst zone to produce a hydrocarbon effluent comprising a range of hydrocarbon products, including light olefins, such as described above relative to the system 10.

The effluent from the fluidized reactor zone 214 is passed through a line 216 into a hydrocarbon separation system 220, such as includes a main column section 222 and a staged compression section 224. The main column section 222 may desirably include a main column separator with an associated main column overhead high pressure receiver wherein the fluidized reactor zone effluent can be separated into desired fractions including a main column vapor stream, such as passed through a line 226, and a main column liquid stream, such as passed through a line 230.

As with the above-described embodiment, other fraction lines such as including a heavy gasoline stream, a light cycle oil ("LCO") stream, a heavy cycle oil ("HCO") stream and a clarified oil ("CO") stream, for example, may not here be shown nor hereinafter specifically described so as to facilitate illustration and discussion.

The main column vapor stream line 226 is introduced into the staged compression section 224, such as constituting a three-stage compression. The staged compression section 224 results in the formation of a high pressure separator vapor stream, such as described above, in a line 233.

As in the system 10, the compression section 224 may also result in the formation of a stream of spill back materials largely composed of heavier hydrocarbon materials and typically in the form of a liquid and such as can be passed via one or more lines 235 for further processing or treatment as later described herein.

If desired and as shown similar to the system 10, the system 210 passes the separator vapor stream via the line 233 and a line 234 into an amine treatment section 240 such as described above and such as may be desired to effect $CO_2$ removal therefrom.

Also as described above, a stream containing $C_4$− hydrocarbons substantially free of carbon dioxide is passed through a line 242 to a drier section 244. A stream containing stripped hydrocarbons and possibly minor amounts (e.g., typically less than 1 wt. %) of $CO_2$ is conveyed via a line 246 back to the compression section 224 such as for further processing such as consistent with the above description. A stream containing $CO_2$ rich purge gas is conveyed from the amine treatment section 240 via a line 247. A stream containing dried $C_4$− hydrocarbons substantially free of carbon dioxide is passed via a line 248 to a deethanizer 250. A suitable such deethanizer, in accordance with one preferred embodiment, has been described above in connection with the description of system 10.

Similar to the system 10 shown in FIG. 1 and described above, a stream of $C_2$− hydrocarbons is taken overhead from the deethanizer 250 via a line 252. The line 252 and the stream of materials therein contained are introduced into a compressor section 254 to form a corresponding stream of compressed materials (such as being at a pressure in the range of about 3720 kPa gauge to about 3865 kPa gauge (about 540 psig to about 560 psig)) that are passed through a line 256 to an overhead receiver 257. From the overhead receiver 257, a stream of the compressed material is passed via a line 258 as a reflux to the deethanizer 250 and a stream of the compressed material is passed via a line 259 to an acetylene conversion section or unit 260 effective to convert acetylene to form ethylene. Thus, an additionally ethylene-enriched process stream is withdrawn in a line 262 from the acetylene conversion section or unit 260.

The process stream in the line 262 is introduced into a suitable demethanizer 264, such as described above. A stream of methane and hydrogen gas from the demethanizer 264 is taken overhead by via a line 266 such as for use as a fuel or, if desired for further processing or treatment such as to a pressure swing absorption unit (not shown) for $H_2$ recovery.

A line 270 withdraws a stream of demethanized material from the demethanizer 264. The stream of demethanized material in line 270 is passed to a suitable ethylene/ethane splitter 272, such as described above. The ethylene/ethane splitter 272 forms a stream of ethylene and a stream of ethane which are passed through lines 274 and 276, respectively, such as either for product recovery or further desired processing, as is known in the art.

The deethanizer 250 also produces or forms a stream of $C_3$+ hydrocarbons such as withdrawn therefrom via a line 280. The line 280 introduces the materials passing therein into a depropanizer 282. In addition and as shown, the main column liquid stream line 230 can also desirably be introduced into the depropanizer 282. Suitable such depropanizers are described above.

A stream of $C_3$ hydrocarbons is taken overhead from the depropanizer 282 via a line 284. A selective hydrogenation process unit 286, such as described above, may be provided to convert diolefinic materials present in such stream materials to corresponding olefin materials. The resulting stream is passed via a line 290 to a suitable propylene/propane splitter 292, such as described above. The propylene/propane splitter 292 forms a stream of propylene and a stream of propane which are passed through lines 294 and 296, respectively, such as either for product recovery or further desired processing, as is known in the art.

A line 300 withdraws a stream containing residual $C_4$+ hydrocarbons from the depropanizer 282. As such a depropanizer bottoms stream contains very little material in the $C_7$+ range, such material can if desired be processed via olefin cracking processing, as further described below, without requiring additional pre-cracking fractionation. If desired and as shown, the line 300 with the stream containing residual $C_4$+ hydrocarbons from the depropanizer 282 can be introduced into a mercaptan treatment section 302, such as via a line 303, such as to effect mercaptan removal from the stream materials such as via caustic wash as is known in the art. In the illustrated embodiment, the liquid from the line 235 can also desirably be introduced into the mercaptan treatment section 302 via the line 303 such as to effect mercaptan removal therefrom.

A resulting stream is withdrawn from the mercaptan treatment section 302 via a line 304. As such stream materials may contain diolefinic materials, in the illustrated embodiment such stream of materials is passed via the line 304 and a line 305 to a selective hydrogenation process unit 306 to convert such diolefinic materials to corresponding olefin materials.

A resulting stream containing $C_4$+ hydrocarbons is passed via a line 310 for further desired processing. For example and as shown, the resulting stream containing $C_4$+ hydrocarbons is passed via the line 310 and a line 340 to a cracking zone 342 or, more particularly, an olefin catalytic cracking reactor zone such as wherein at least a portion of the stream materials contact with an olefin cracking catalyst and at reaction conditions, in a manner as is known in the art, effective to convert at least a portion of the quantity of the $C_4$-$C_7$ olefins therein contained to a cracked olefins effluent stream comprising light olefins passed via a line 344 into an olefin cracking process depropanizer 346.

A suitable such depropanizer, in accordance with one preferred embodiment, includes a condenser (not specifically shown) that desirably operates at a pressure in the range of about 1030 kPa gauge to about 1175 kPa gauge (about 150 psig to about 170 psig), with a recovery of at least about 98 mol % of the $C_3$ hydrocarbons in the overhead, more preferably with the recovery of at least in the range of 98-99.5 mol % of the $C_3$ hydrocarbons in the overhead and at least 95 mol % of the $C_4$+ hydrocarbons in the bottoms product, more preferably with the recovery of at least about 95 mol % to about 99 mol % of the $C_4$+ hydrocarbons in the bottoms product.

A stream of $C_3$ hydrocarbons is taken overhead from the depropanizer 346 via a line 350 and passed through the line 234 to the amine treatment section 240 described above for further processing consistent therewith.

The resulting stream is passed via a line 352 to a naphtha splitter 312 such as described above. In accordance with one preferred embodiment, a suitable such naphtha splitter is desirably in the form of a dividing wall separation column, such as having a dividing wall 314 positioned therewithin. The naphtha splitter 312, similar to the naphtha splitter 112 described above, is desirably effective to separate the depropanized materials introduced therein into a light fraction stream comprising compounds containing four to six carbon atoms, an intermediate fraction stream comprising compounds containing seven to eight carbon atoms, and a heavy fraction stream comprising compounds containing more than eight carbon atoms.

As will be appreciated by those skilled in the art and guided by the teachings herein provided, such light, intermediate and heavy fraction streams may desirably be appropriately passed such as via corresponding lines 322, 324, and 326, respectively, either for further processing or product recovery, as may be desired. For example and as shown, the light fraction stream of the line 322 can desirably be split so as to form a first portion passed via a line 327 and the line 340 to the olefin catalytic cracking reaction zone 342 for further processing consistent therewith. A second portion of the light fraction stream of the line 322 is passed via a line 328 and introduced into a debutanizer 330. Suitable such debutanizers are described above.

Similar to the above-described embodiment, a stream of mixed $C_4$ hydrocarbons is taken overhead from the debutanizer 330 via a line 332. A stream primarily comprising compounds containing $C_5$ and $C_6$ compounds is taken from the debutanizer 330 via a bottoms stream in a line 334.

Figure 2:
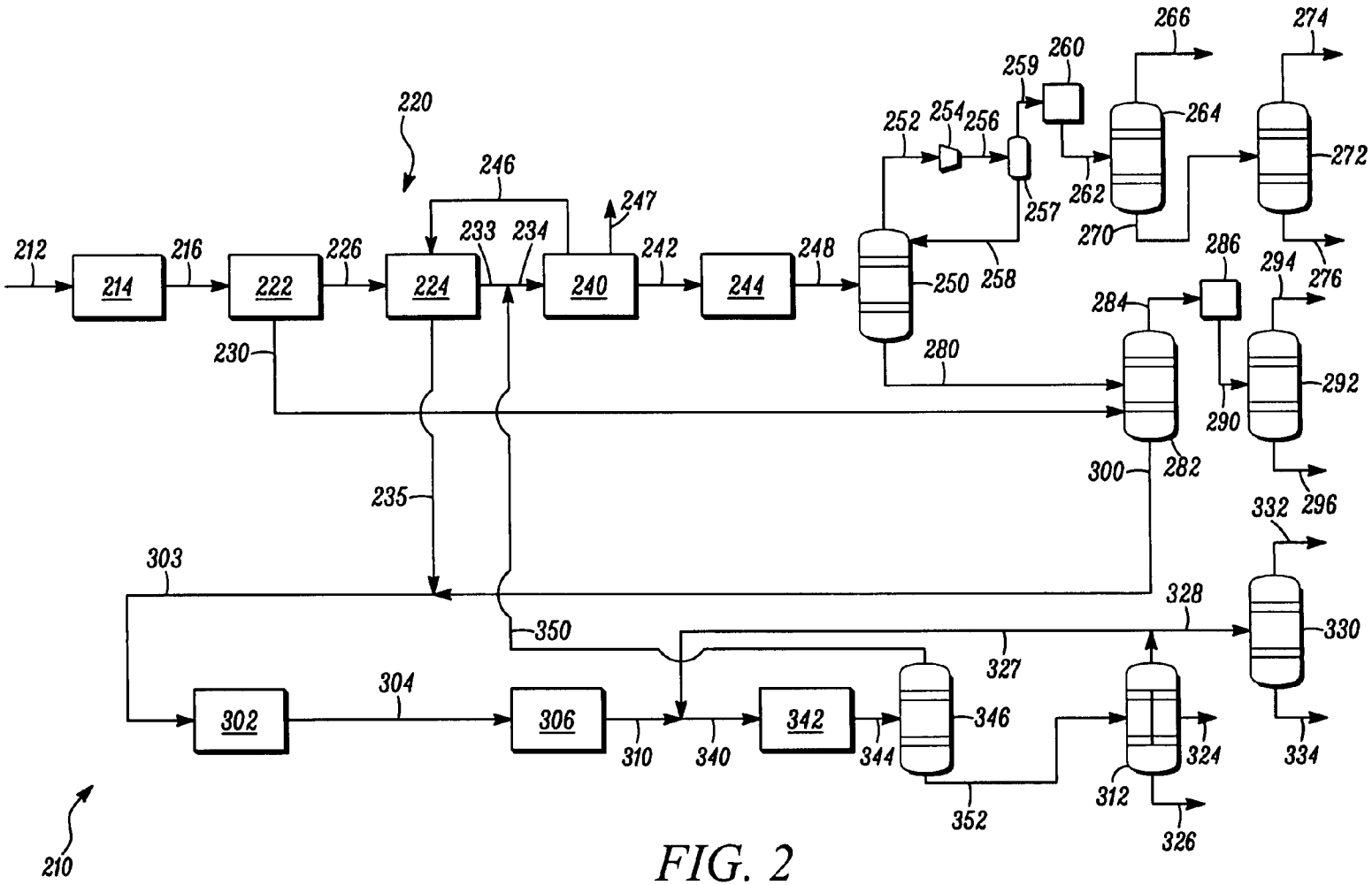
FIG. 2 is a simplified schematic diagram of a system for catalytic cracking a heavy hydrocarbon feedstock and obtaining selected hydrocarbon fractions, including light olefins via fractionation recovery, in accordance with another preferred embodiment.

Those skilled in the art and guided by the teachings herein provided will further appreciate that an operator may under certain circumstances prefer to operate using the system 10 shown in FIG. 1 while under other circumstances may prefer to operate using the system 310 shown in FIG. 2. For example, an operator may prefer to use the system 10, such as by taking the olefins cracking zone and the olefin cracking process depropanizer of the system 310 offline, such as in order to increase gasoline production. Alternatively, be placing such olefins cracking zone and the olefin cracking process depropanizer back on line, an operator may employ the system 310 such as in those circumstances where the operator is seeking to increase or maximize light olefin production.

Thus processing schemes and arrangements are desirably provided for obtaining light olefins via the catalytic cracking of a heavy hydrocarbon feedstock. More particularly, processing schemes and arrangements are provided that advantageously utilize fractionation of hydrocarbon effluent products to produce or otherwise form process streams containing specifically desired ranges of hydrocarbons.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A process for catalytically cracking a heavy hydrocarbon feedstock and obtaining selected hydrocarbon fractions, the process comprising:

contacting a heavy hydrocarbon feedstock with a hydrocarbon cracking catalyst having a catalyst composition including a first component comprising a large pore molecular sieve and a second component comprising a zeolite with no greater than medium pore size to produce a hydrocarbon effluent comprising a range of hydrocarbon products, said zeolite with no greater than medium pore size comprising at least 1.0 wt. % of the catalyst composition;

separating the hydrocarbon effluent in a separation section to form at least one separator liquid stream and a separator vapor stream, the at least one separator liquid stream comprising $C_4$+ hydrocarbons, the separator vapor stream comprising $C_4$− hydrocarbons;

deethanizing at least a portion of the separator vapor stream in a deethanizer to at least form a first deethanizer process stream comprising $C_2$− hydrocarbons including a quantity of ethylene and a second deethanizer process stream comprising $C_3$+ hydrocarbons including a quantity of propylene;

depropanizing the second deethanizer process stream to form a first depropanizer process stream comprising $C_3$ hydrocarbons and a second depropanizer process stream comprising $C_4$+ hydrocarbons including a quantity of $C_4$-$C_7$ olefins;

splitting at least a portion of the second depropanizer process stream in a naphtha splitter to at least form a first naphtha splitter process stream comprising primarily compounds containing four to six carbon atoms;

cracking at least a portion of the $C_4$-$C_7$ olefins to form a cracked olefin effluent comprising $C_2$ and $C_3$ olefins;

depropanizing at least a portion of the cracked olefin effluent to form a first cracked olefin effluent process stream comprising $C_3$− hydrocarbons including $C_2$ and $C_3$ olefins and a second cracked olefin effluent process stream comprising $C_4$+ hydrocarbons; and recovering at least a portion of the $C_2$ and $C_3$ olefins from the first cracked olefin effluent process stream.

2. The process of claim 1 wherein said contacting of the heavy hydrocarbon feedstock with a hydrocarbon cracking catalyst comprises contacting the heavy hydrocarbon feedstock with a blended catalyst comprising regenerated catalyst and coked catalyst in a fluidized reactor zone at hydrocarbon cracking reaction conditions to produce a cracked stream containing hydrocarbon products including light olefins.

3. The process of claim 1 wherein the recovering of at least a portion of the $C_2$ and $C_3$ olefins from the first cracked olefin effluent process stream comprises deethanizing at least a portion of the first cracked olefin effluent process stream in the deethanizer.

4. The process of claim 1 wherein said cracking of at least a portion of the $C_4$-$C_7$ olefins of the second depropanizer process stream comprises introducing at least a portion of the quantity of the $C_4$-$C_7$ olefins of the second depropanizer process stream into a catalytic cracking reactor zone.

5. The process of claim 4 additionally comprising:

also introducing at least a portion of the at least one separator liquid stream into the catalytic cracking reactor zone and wherein said cracking comprises cracking at least a portion of the at least one separator liquid stream.

6. The process of claim 1 additionally comprising:

demethanizing at least a portion of the first deethanizer process stream to form a first demethanizer process stream comprising hydrogen and methane and a second demethanizer process stream comprising $C_2$ hydrocarbons including at least a portion of the quantity of ethylene; and splitting the second demethanizer product stream in a $C_2$ hydrocarbon splitter to form a first $C_2$ hydrocarbon splitter process stream comprising ethylene and a second $C_2$ hydrocarbon splitter process stream comprising ethane.

7. The process of claim 6 additionally comprising:

compressing the at least a portion of the first deethanizer process stream prior to said demethanizing.

8. The process of claim 7 wherein the first deethanizer process stream additionally comprises a quantity of acetylene, the process additionally comprising:

subsequent to said compressing, converting at least a portion of the quantity of acetylene to form a first deethanizer process stream enriched in ethylene.

9. The process of claim 1 additionally comprising:

splitting at least a portion of the first depropanizer process stream in a $C_3$ hydrocarbon splitter to form a first $C_3$ hydrocarbon splitter product stream comprising propylene and a second $C_3$ hydrocarbon splitter product stream comprising propane.

10. The process of claim 1 additionally comprising:

debutanizing at least a portion of the first naphtha splitter process stream to form a first debutanizer process stream primarily comprising compounds containing four carbon atoms and a second debutanizer process stream primarily comprising compounds containing $C_5$ and $C_6$ hydrocarbons.

11. The process of claim 1 wherein the separator vapor stream comprises a quantity of carbon dioxide and wherein the process additionally comprises:

treating at least a portion of the separator vapor stream in an amine treatment section with an amine absorption solvent at treatment conditions effective to absorb a significant portion of the carbon dioxide from the contacted portion of the separator vapor stream and to form a feed stream substantially free of carbon dioxide to the deethanizer.

12. The process of claim 1, wherein the splitting step comprises:

introducing at least a portion of the second depropanizer process stream comprising the naphtha feedstock comprising $C_4$ to $C_9$+ hydrocarbons into a dividing wall separation column and separating the feedstock into a light fraction comprising compounds containing four to six carbon atoms, an intermediate fraction comprising compounds containing seven to eight carbon atoms and a heavy fraction comprising compounds containing more than eight carbon atoms.

13. A process for catalytically cracking a heavy hydrocarbon feedstock and obtaining selected hydrocarbon fractions, the process comprising:

contacting a heavy hydrocarbon feedstock with a hydrocarbon cracking catalyst in a fluidized reactor zone to produce a hydrocarbon effluent comprising a range of hydrocarbon products including light olefins, the hydrocarbon cracking catalyst having a catalyst composition including a first component comprising a large pore molecular sieve and a second component comprising a zeolite with no greater than medium pore size, said zeolite with no greater than medium pore size comprising at least 1.0 wt. % of the catalyst composition;

separating the hydrocarbon effluent in a separation section to form at least one separator liquid stream and a separator vapor stream, the at least one separator liquid stream comprising $C_4$+ hydrocarbons, the separator vapor stream comprising $C_4$− hydrocarbons;

deethanizing at least a portion of the separator vapor stream in a deethanizer to at least form a first deethanizer process stream comprising $C_2$− hydrocarbons including a quantity of ethylene and a second deethanizer process stream comprising $C_3$+ hydrocarbons including a quantity of propylene;

depropanizing the second deethanizer process stream to form a first depropanizer process stream comprising $C_3$ hydrocarbons and a second depropanizer process stream comprising $C_4$+ hydrocarbons including $C_4$-$C_7$ olefins;

cracking at least a portion of the $C_4$-$C_7$ olefins to form a cracked olefin effluent comprising $C_2$ and $C_3$ olefins;

depropanizing at least a portion of the cracked olefin effluent to form a first cracked olefin effluent process stream comprising $C_3$− hydrocarbons including $C_2$ and $C_3$ olefins and a second cracked olefin effluent process stream comprising $C_4$+ hydrocarbons; and splitting at least a portion of the second cracked olefin effluent process stream in a naphtha splitter comprising a dividing wall separation column to form a light fraction comprising compounds containing four to six carbon atoms, an intermediate fraction comprising compounds containing seven to eight carbon atoms and a heavy fraction comprising compounds containing more than eight carbon atoms.

14. The process of claim 13 additionally comprising:

demethanizing at least a portion of the first deethanizer process stream to form a first demethanizer process stream comprising hydrogen and methane and a second demethanizer process stream comprising $C_2$ hydrocarbons including at least a portion of the quantity of ethylene; and splitting the second demethanizer product stream in a $C_2$ hydrocarbon splitter to form a first $C_2$ hydrocarbon splitter process stream comprising ethylene and a second $C_2$ hydrocarbon splitter process stream comprising ethane.

15. The process of claim 14 wherein the first deethanizer process stream additionally comprises a quantity of acetylene, the process additionally comprising:

compressing the at least a portion of the first deethanizer process stream and converting at least a portion of the quantity of acetylene to form a first deethanizer process stream enriched in ethylene, prior to said demethanizing.

16. The process of claim 14 additionally comprising:

splitting at least a portion of the first depropanizer process stream in a $C_3$ hydrocarbon splitter to form a first $C_3$ hydrocarbon splitter product stream comprising propylene and a second $C_3$ hydrocarbon splitter product stream comprising propane.

17. The process of claim 13 additionally comprising:

debutanizing at least a portion of the first naphtha splitter process stream to form a first debutanizer process stream primarily comprising compounds containing four carbon atoms and a second debutanizer process stream primarily comprising compounds containing $C_5$ and $C_6$ hydrocarbons.

18. The process of claim 13 wherein the separator vapor stream comprises a quantity of carbon dioxide and wherein the process additionally comprises:

treating at least a portion of the separator vapor stream in an amine treatment section with an amine absorption solvent at treatment conditions effective to absorb a significant portion of the carbon dioxide from the contacted portion of the separator vapor stream and to form a feed stream substantially free of carbon dioxide to the deethanizer.

* * * * *